US010873805B2

(12) United States Patent
Chang et al.

(10) Patent No.: US 10,873,805 B2
(45) Date of Patent: Dec. 22, 2020

(54) SOUND PROCESSING APPARATUS AND AUDIO SIGNALS PROCESSING METHOD THEREOF BASED ON SOUND SOURCE POSITION

(71) Applicant: Wistron Corporation, New Taipei (TW)

(72) Inventors: Tzu-Peng Chang, New Taipei (TW); Chuan-Yen Kao, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/226,579

(22) Filed: Dec. 19, 2018

(65) Prior Publication Data

US 2020/0068301 A1 Feb. 27, 2020

(30) Foreign Application Priority Data

Aug. 24, 2018 (TW) ..... 107129575 A

(51) Int. Cl.
*H04R 3/00* (2006.01)
*H04R 5/027* (2006.01)
*H04R 5/04* (2006.01)

(52) U.S. Cl.
CPC ..... *H04R 3/005* (2013.01); *H04R 5/027* (2013.01); *H04R 5/04* (2013.01); *H04R 2430/21* (2013.01)

(58) Field of Classification Search
CPC ..... H04R 3/005; H04R 5/027; H04R 5/04; H04R 2430/21

(Continued)

(56) References Cited

U.S. PATENT DOCUMENTS 9,552,840 B2 1/2017 Kim et al.
2010/0150364 A1* 6/2010 Buck ..... G01S 3/807 381/66

(Continued)

FOREIGN PATENT DOCUMENTS

| | | |
|---|---|---|
| CN | 102137318 | 7/2011 |
| CN | 103181192 | 6/2013 |
| TW | 201334580 | 8/2013 |

OTHER PUBLICATIONS

"Office Action of Taiwan Counterpart Application", dated Mar. 19, 2019, p1-p10.

(Continued)

*Primary Examiner* — Vivian C Chin
*Assistant Examiner* — Douglas J Suthers
(74) *Attorney, Agent, or Firm* — JCIPRNET

(57) ABSTRACT

A sound processing apparatus and a sound processing method thereof are provided. The following steps are included. Multiple first sound signals corresponding to multiple sound reception sources are obtained. A sound source position of a sound source relative to the sound reception sources is determined. A relationship among multiple sound receiving directions corresponding to the sound reception sources is determined according to the sound source position. The sound receiving directions relate to directionality of the sound reception sources. A second sound signal is outputted from the first sound signals based on the relationship among the sound receiving directions. Accordingly, an optimal sound receiving direction corresponding to the sound source can be adjusted automatically, so as to improve sound quality.

17 Claims, 10 Drawing Sheets

(58) Field of Classification Search
USPC ..... 381/26, 92
See application file for complete search history.

(56) References Cited

U.S. PATENT DOCUMENTS

| | | | | |
|---|---|---|---|---|
| 2011/0286609 | A1* | 11/2011 | Faller ..... | H04R 3/005 381/92 |
| 2012/0028160 | A1 | 2/2012 | Kanuri et al. | |
| 2013/0142341 | A1 | 6/2013 | Del Galdo et al. | |

OTHER PUBLICATIONS

"Office Action of China Counterpart Application", dated Oct. 27, 2020, p. 1-p. 10.

* cited by examiner

SOUND PROCESSING APPARATUS AND AUDIO SIGNALS PROCESSING METHOD THEREOF BASED ON SOUND SOURCE POSITION

CROSS-REFERENCE TO RELATED APPLICATION

This application claims the priority benefit of Taiwan application serial no. 107129575, filed on Aug. 24, 2018. The entirety of the above-mentioned patent application is hereby incorporated by reference herein and made a part of this specification.

BACKGROUND

Technical Field

The disclosure relates to a sound signal processing technique, particularly to a sound processing apparatus and a sound processing method thereof.

Related Art

Microphones have long been used to record sound or to amplify and output sound. Users generally wish to have a microphone only record the sound from a target sound source. However, in most cases, it is hard to establish an environment for recording without sound interference. A traditional microphone may be affected by external sounds, echoes and other factors, such that quality of the recorded sound is affected. With the advancement of technology, microphone beamforming technology has been proposed and widely used to solve the aforementioned problem. The sound within a beam pattern formed based on a beamforming algorithm can be clearly recorded, while the sound outside the beam pattern is greatly attenuated. By placing the target sound source in the range of the beam pattern, it is possible to reduce sound energy of an interference source and make the target sound clear and loud. However, most microphones with beamforming technology can only provide a single sound receiving direction. Although a small number of microphones provide two or more sound receiving directions, their function is limited to switching between specific sound receiving directions and not all directions can be covered. Therefore, the user has to manually move the target sound source into a specific range in order to make use of the beamforming technology, which is quite inconvenient.

SUMMARY

The disclosure provides a sound processing apparatus and a sound processing method thereof, by which an optimal sound receiving direction corresponding to a sound source can be automatically adjusted, thereby improving sound quality.

The sound processing method of the disclosure includes the following steps. Multiple first sound signals corresponding to multiple sound reception sources are obtained. A sound source position of a sound source relative to the sound reception sources is determined. A relationship among multiple sound receiving directions corresponding to the sound reception sources is determined according to the sound source position, wherein the sound receiving directions relate to directionality of the sound reception sources. A second sound signal from the first sound signals is outputted based on the relationship among the sound receiving directions.

In an embodiment of the disclosure, the relationship includes weights of the sound receiving directions, and the step of determining the relationship among the sound receiving directions corresponding to the sound reception sources according to the sound source position includes the following. Multiple sound reception combinations are formed from the first sound signals, wherein each sound reception combination includes at least one of the sound reception sources, and each sound reception combination corresponds to one of the sound receiving directions. The corresponding weights are determined according to the sound receiving directions of the sound reception combinations.

In an embodiment of the disclosure, the step of forming the sound reception combinations from the first sound signals includes the following. One of the sound receiving direction corresponding to the sound reception combination is determined according to a beamforming algorithm.

In an embodiment of the disclosure, the beamforming algorithm is a differential microphone array (DMA) algorithm, and the step of determining one of the sound receiving direction corresponding to the sound reception combination according to the beamforming algorithm includes the following. The first sound signals in the corresponding sound reception combinations are processed using the DMA algorithm.

In an embodiment of the disclosure, before the corresponding weights are determined according to the sound receiving directions of the sound reception combinations, the following is further included. A reference position is determined. Multiple reference source directions radiated from the reference position are provided, wherein each reference source direction has a predetermined weight corresponding to the sound reception combinations.

In an embodiment of the disclosure, the step of determining the corresponding weights according to the sound receiving directions of the sound reception combinations includes the following. A sound source direction of the sound source position relative to the reference position is determined. The weights corresponding to the sound reception combinations are determined according to the predetermined weight corresponding to each of the reference source directions near the sound source direction.

In an embodiment of the disclosure, the step of determining the corresponding weights according to the sound receiving directions of the sound reception combinations includes the following. A sound source direction of the sound source position relative to the reference position is determined. The sound reception combinations having a beam pattern covering the sound source direction are selected.

In an embodiment of the disclosure, the step of outputting the second sound signal from the first sound signals based on the determined weights includes the following. A weighting operation is performed on the sound reception combinations with the determined corresponding weights to generate the second sound signal.

In an embodiment of the disclosure, the step of determining the sound source position corresponding to the first sound signals includes the following. The sound source position is determined based on a sound source localization (SSL) technique.

The sound processing apparatus of the disclosure, adapted for processing multiple first sound signals, includes a storage and a processor. The storage stores multiple modules and the first sound signals. The modules include a source detection module, a weight determination module and a sound output module. The first sound signals correspond to multiple sound reception sources. The processor is coupled to the storage and executes the modules stored in the storage. The source detection module determines a sound source position of a sound source relative to the sound reception sources. The weight determination module determines a relationship of multiple sound receiving directions corresponding to the sound reception sources according to the sound source position. The sound receiving directions relate to directionality of the sound reception sources. The sound output module outputs a second sound signal from the first sound signals based on a relationship among the sound receiving directions.

In an embodiment of the disclosure, the relationship includes the weights of the sound receiving directions. The weight determination module forms multiple sound reception combinations from the first sound signals, and each sound reception combination includes at least one of the sound reception sources, and each sound reception combination forms one of the sound receiving directions. The weight determination module determines the corresponding weight according to the sound receiving directions of the sound reception combinations.

In an embodiment of the disclosure, the weight determination module determines the sound receiving direction corresponding to one of the sound reception combination according to a beamforming algorithm.

In an embodiment of the disclosure, the weight determination module processes the first sound signals in the corresponding sound reception combination using a DMA algorithm.

In an embodiment of the disclosure, the weight determination module determines a reference position and provides multiple reference source directions radiated from the reference position, wherein each reference source direction has a predetermined weight corresponding to the sound reception combinations.

In an embodiment of the disclosure, the weight determination module determines a sound source direction of the sound source position relative to the reference position, and determines the weights corresponding to the sound reception combinations according to the predetermined weight corresponding to each of the reference source direction near the sound source direction.

In an embodiment of the disclosure, the modules further include an output determination module. The weight determination module determines a sound source direction of the sound source relative to the reference position, and the output determination module selects the sound reception combinations having a beam pattern covering the sound source direction.

In an embodiment of the disclosure, the weight determination module performs a weighting operation on the sound reception combinations with the determined corresponding weights to generate the second sound signal.

In an embodiment of the disclosure, the source detection module determines the sound source position based on an SSL technique.

In an embodiment of the disclosure, the processor is further connected to multiple sound reception apparatuses, and each sound reception apparatus corresponds to one of the sound reception sources and obtains one of the first sound signals.

Based on the above, in the sound processing apparatus and the sound processing method thereof according to the embodiment of the disclosure, the first sound signals obtained by several sound reception apparatuses can be grouped into several beam patterns by the beamforming algorithm. Then, the weights of the sound receiving directions corresponding to the beam patterns is determined based on the sound source direction of the sound source relative to the sound reception apparatuses. Finally, the first sound signals can be processed using the weights, such that the sound source can be clearer and external noise can be greatly reduced. In addition, in the embodiment of the disclosure, in response to a change in the sound source direction, the weight can be dynamically changed, so as to receive sound in an optimal sound receiving direction at any time.

To make the above features and advantages of the disclosure more comprehensible, examples accompanied with drawings are described in detail as follows.

DESCRIPTION OF THE EMBODIMENTS

Figure 1:
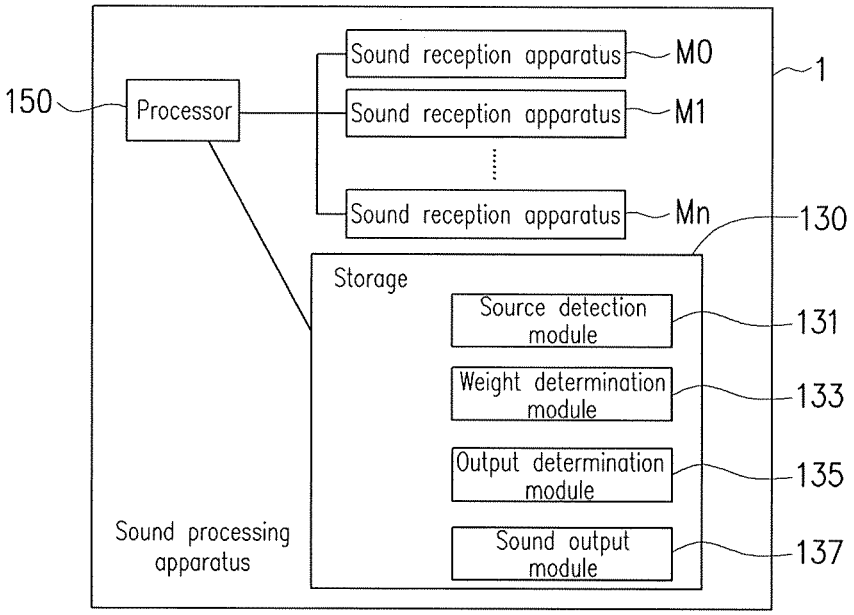
FIG. 1 is a block diagram of components of a sound processing apparatus according to an embodiment of the disclosure.

FIG. 1 is a block diagram of components of a sound processing apparatus 1 according to an embodiment of the disclosure. Referring to FIG. 1, the sound processing apparatus 1 includes, but not limited to, multiple sound reception apparatuses M0 to Mn, a storage 130, and a processor 150, where n is a positive integer greater than one.

The sound reception apparatuses M0 to Mn include, but not limited to, microphones, analog-to-digital converters, filters, and audio processors. The microphones of the sound reception apparatuses M0 to Mn may be, for example, dynamic microphones, condenser microphones, electret condenser microphones, microelectrical-mechanical system (MEMS) microphones, etc., which may be omnidirectional or directional) or other electronic components capable of receiving sound waves (e.g., generated by human voice, ambient sounds, machine operating sounds, etc.) and converting them into first sound signals. In the present embodiment, each of the sound reception apparatuses M0 to Mn generates a set of first sound signals or a single first sound signal in response to reception of the sound waves, so that the sound processing apparatus 1 obtains multiple first sound signals. In addition, each of the sound reception apparatuses M0 to Mn may be used as a sound reception source (i.e., corresponding to a sound reception source) in parameters or variables in a software/firmware program in the present embodiment. Each sound reception source is a representative of reception of a set of first sound signals or a single first sound signal, and may be assigned a corresponding number or identification code (e.g., the numbers M0 to Mn, etc. of the sound reception apparatuses). In other embodiments, the sound reception source may also be referred to as physical sound reception apparatuses M0 to Mn. For example, the sound reception source may be multiple microphones built in the sound processing apparatus 1, or multiple microphones externally connected to the sound processing apparatus 1.

The storage 130 may be any type of fixed or portable random access memory (RAM), read only memory (ROM), flash memory, traditional hard disk drive (HDD), solid-state drive (SSD) or similar component. The storage 130 is configured to store a code, a software module (e.g., source detection module 131, weight determination module 133, output determination module 135, sound output module 137, etc.), a first sound signal, a weight, a sound reception source, a sound source, a sound source direction, a lookup table of reference source directions with predetermined weights, a beamforming algorithm and other data or files. Details thereof are to be described in detail in the subsequent embodiments.

The processor 150 is coupled to the sound reception apparatuses M0 to Mn and the storage 130. The processor 150 may be a central processing unit (CPU), or other programmable general purpose or special purpose microprocessor, a digital signal processor (DSP), a programmable controller, an application-specific integrated circuit (ASIC) or other similar component or a combination of the above components. In the embodiment of the disclosure, the processor 150 is configured to execute all operations of the sound processing apparatus 1.

It is to be noted that, the embodiment of FIG. 1 shows that the sound reception apparatuses M0 to Mn are built in the sound processing apparatus 1. However, in other embodiments, the sound reception apparatuses M0 to Mn may be externally connected to the sound processing apparatus 1 via various types of digital or analog audio lines. The sound reception apparatuses M0 to Mn can even transmit the first sound signals to the processor 150 by wireless communication technology (e.g., Bluetooth, Wi-Fi, etc.).

To facilitate understanding of an operation process in the embodiment of the disclosure, a processing flow for a sound signal in the embodiment of the disclosure will be hereinafter explained in detail with reference to numerous examples. In the following, the method according to the embodiment of the disclosure will be explained with reference to devices, components and modules in the sound processing apparatus 1. The steps in this method may be varied according to actual situations and are not limited to those described herein.

Figure 2:
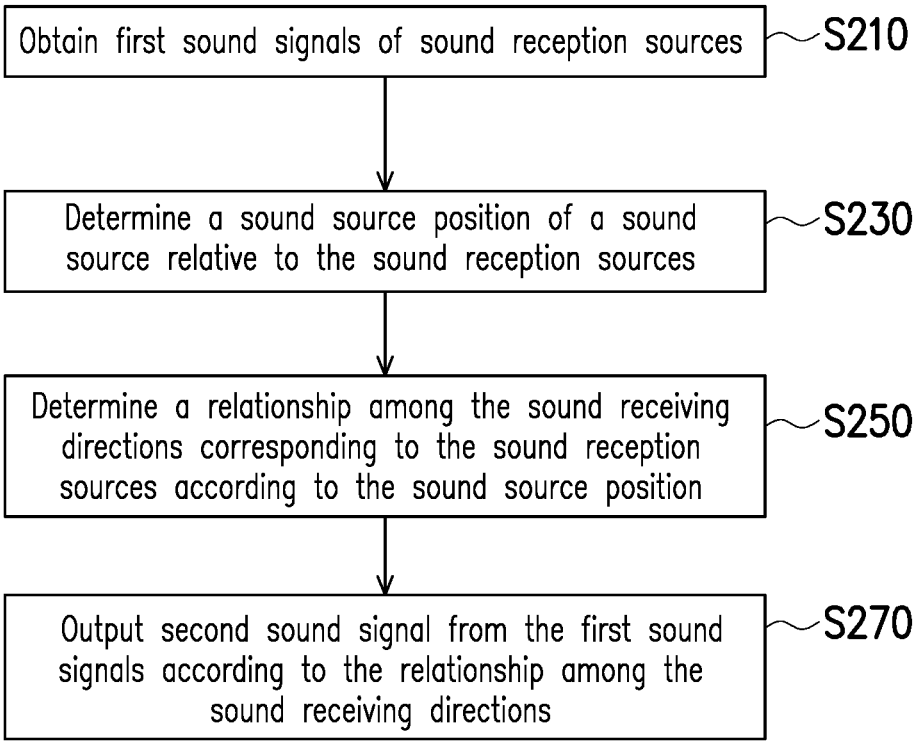
FIG. 2 is a flowchart of a sound processing method according to an embodiment of the disclosure.

FIG. 2 is a flowchart of a sound processing method according to an embodiment of the disclosure. Referring to FIG. 2, the processor 150 obtains a corresponding set of first sound signals through each sound reception source (each of the sound reception apparatuses M0 to Mn) (step S210). In the present embodiment, the weight determination module 133 forms multiple sound reception combinations from the first sound signals. Each sound reception combination includes one or more sets of first sound signals. For example, one sound reception combination may include first sound signals from the sound reception apparatuses M0 and M2, another sound reception combination may include first sound signals from the sound reception apparatuses M3, M4 and M5. The first sound signals included in each sound reception combination may be freely adjusted according to needs. Each sound reception combination forms a sound receiving direction. This sound receiving direction refers to a direction in which a sound reception combination has optimal sensitivity or gain value in response to a specific angle (i.e., relating to directionality of a sound reception source or a beam pattern (which may be omnidirectional, cardioid, hypercardioid, and supercardioid, etc.)). In addition, the sound receiving direction is, for example, a direction formed by extending from positions of the sound reception apparatuses M0 to Mn to outermost points of beam patterns of the sound reception apparatuses M0 to Mn.

If the sound reception apparatuses M0 to Mn are directional sound reception apparatuses, they can form specific sound receiving directions. That is, each of the directional sound reception apparatuses M0 to Mn can form a sound reception combination. With respect to sound reception apparatuses M0 to Mn with omnidirectional directionality, the weight determination module 133 may determine a sound receiving direction corresponding to a sound reception combination using a beamforming algorithm. In other words, the weight determination module 133 combines the sound reception apparatuses M0 to Mn into a sound reception combination based on the beamforming algorithm, and forms a directional beam pattern.

Figure 3A:
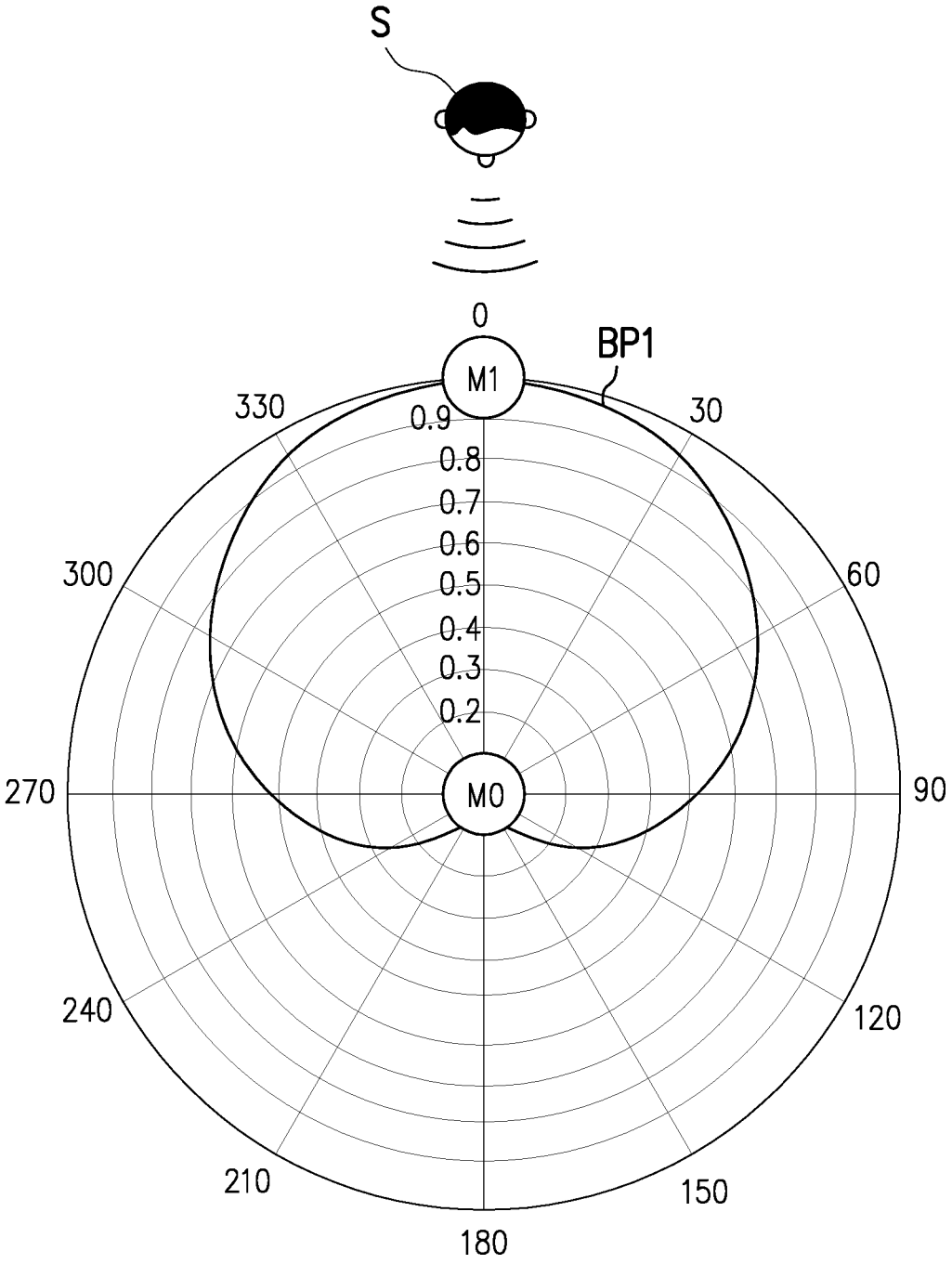
FIG. 3A illustrates an example of arrangement positions of sound reception apparatuses and a beam pattern thereof.
Figure 3B:
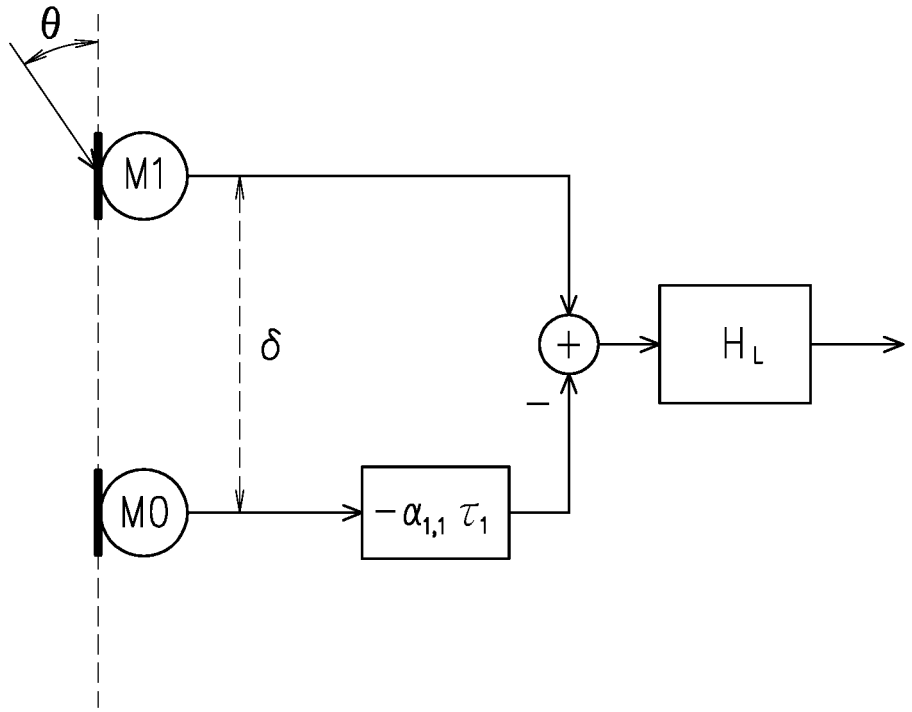
FIG. 3B is a schematic diagram of a differential microphone array (DMA) algorithm.
Figure 3C:
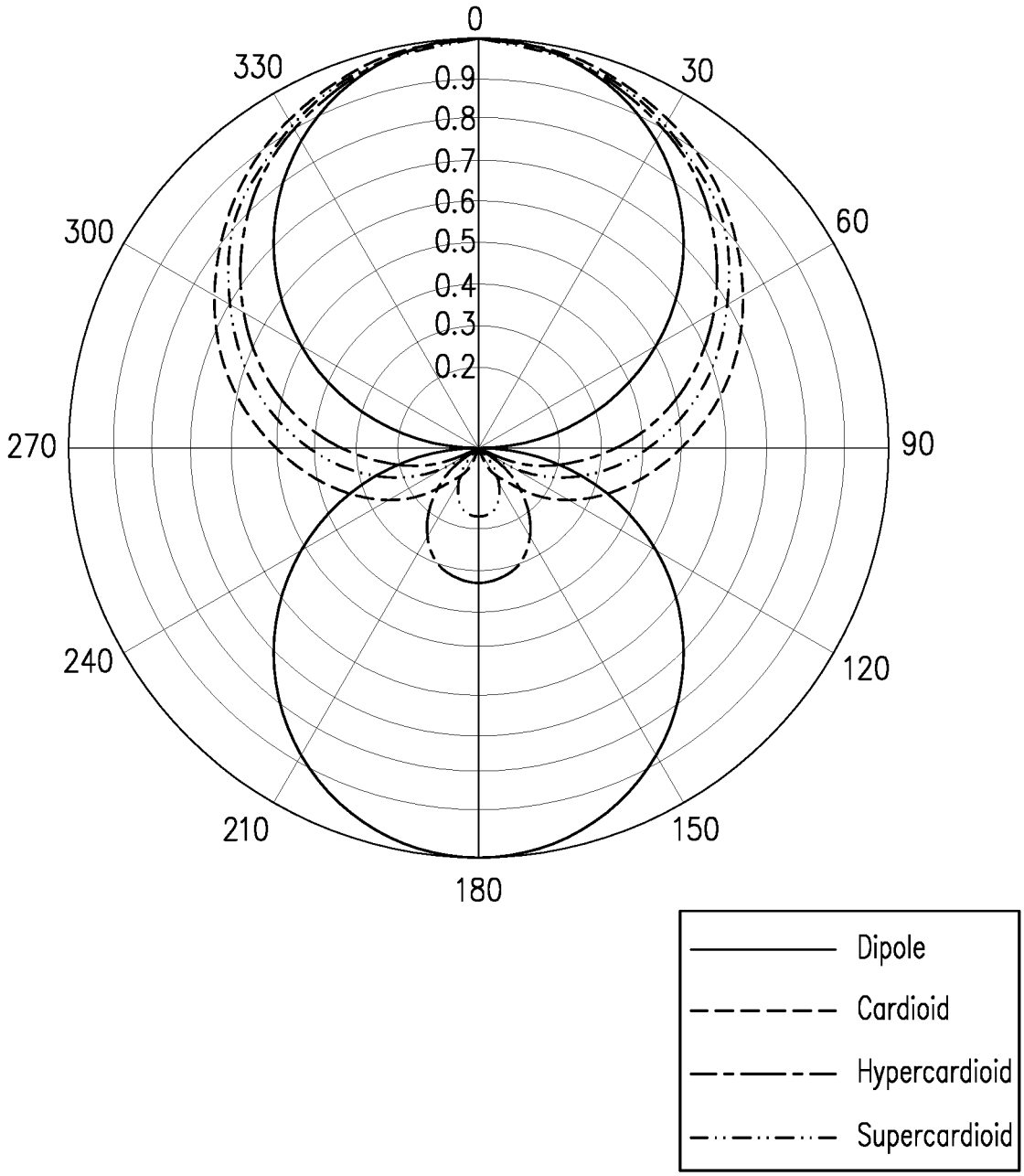
FIG. 3C is a schematic diagram of different beam patterns.

There are many kinds of beamforming algorithms. Taking the differential microphone array (DMA) algorithm as an example, FIG. 3A illustrates an example of arrangement positions of sound reception apparatuses and a beam pattern thereof. It is assumed that the sound reception apparatus M0 is placed at a reference position and arranged in an imaginary straight line (array) along with the sound reception apparatus M1. Please also refer to FIG. 3B. FIG. 3B is a schematic diagram of the DMA algorithm. It is assumed that an imaginary straight line from a position of a sound source S to the sound reception apparatuses M0 and M1 forms an angle θ with the imaginary straight line connecting the two sound reception apparatuses M0 and M1, and a distance between the two sound reception apparatuses M0 and M1 is δ. Since the position of the sound source S is closer to the sound reception apparatus M1, there is a delay τ1 between when a sound wave of the sound source S reaches the sound reception apparatus M1 and when the sound wave of the sound source S reaches the sound reception apparatus M0. The first sound signals of the two sound reception apparatuses M0 and M1 are subjected to subtraction and then filtered (with a filter coefficient $H_L$). Referring next to FIG. 3C which is a schematic diagram of different beam patterns, as a coefficient $\alpha_{1,1}$ shown in FIG. 3B changes, a dipole beam pattern ($\alpha_{1,1}=0$), a Cardioid beam pattern ($\alpha_{1,1}=-1/\sqrt{2}$), a hypercardioid beam pattern ($\alpha^{1,1}=-½$) and a supercardioid beam pattern ($\alpha_{1,1}=-1/\sqrt{2}$) as shown in FIG. 3C can be formed. Abeam pattern BP1 shown in FIG. 3A is the coefficient $\alpha_{1,1}$ corresponding to cardioid. In this way, the weight determination module 133 processes the first sound signals in each sound reception combination by using the DMA algorithm, such that each sound reception combination forms a corresponding directional sound receiving direction.

It is to be noted that, in the DMA algorithm, the first sound signals of an array (formed by arranging the sound reception apparatuses M0 to Mn, wherein the number of sound reception apparatuses included in each array is not limited in the embodiment of the disclosure) are simultaneously subjected to subtraction and then outputted. In other embodiments, a different beamforming algorithm (e.g., delay-and-sum beamforming algorithm, filter-and-sum beamforming algorithm, minimum variance distortionless response (MVDR) beamforming algorithm, etc.) is used in which the first sound signals of an array may be simultaneously subjected to addition and then outputted. In addition, the disclosure does not limit the type of the beamforming algorithm, as long as a beam pattern having a specific directional sound receiving direction can be formed.

In addition, those who apply the embodiment of the disclosure may adjust the sound receiving direction of each sound reception combination according to needs. For example, if the processor 150 forms three sound reception combinations, the processor 150 may separate the sound receiving directions of two adjacent sound reception combinations from each other by, for example, 120 degrees. If the processor 150 forms four sound reception combinations, the processor 150 may separate the sound receiving directions of two adjacent sound reception combinations from each other by, for example, 90 degrees.

Referring back to FIG. 2, when the processor 150 receives the first sound signals from the sound reception apparatuses M0 to Mn, the source detection module 131 determines a sound source position of a sound source relative to the sound reception sources (step S230). In the present embodiment, the source detection module 131 determines the sound source position based on a sound source localization (SSL) technique. For example, as shown in FIG. 3B, according to the delay $\tau_1$ and the distance $\delta$ between the sound reception apparatuses M0 and M1, the source detection module 131 calculates the angle $\theta$ ($\tau_1=\delta\cos(\theta)/\varepsilon$, wherein c is a sound wave velocity). This angle indicates a sound source direction of a position (i.e., the sound source position) where the sound source (i.e., a target sound generating object, e.g., human voice, ambient sounds, music sounds, etc.) is located relative to the reference position where the sound reception apparatus M0 shown in FIG. 3A is located.

It is to be noted that, there are many other algorithms for sound source localization, and the disclosure is not limited to the above. In addition, in the embodiment of the disclosure, it is only necessary to obtain the sound receiving direction of the sound source relative to the sound reception source (sound reception apparatuses M0 to Mn) or the sound reception combination.

Next, the weight determination module 133 determines a relationship among the sound receiving directions corresponding to the sound reception sources according to the sound source position (step S250). In the present embodiment, the relationship among the sound receiving directions includes weights (e.g., specific gravity/proportion, multiple weights, etc.) of the sound receiving directions. The weight determination module 133 determines the corresponding weights according to the sound receiving directions of the sound reception combinations. Specifically, a single sound reception combination or a single sound reception apparatus M0 to Mn can only form a single sound receiving direction. When the sound source position is changed, the first sound signals recorded in the sound reception apparatus M0 to Mn may be greatly attenuated since the sound source is not near the sound receiving direction, thus affecting sound quality. In order to solve the aforementioned problem, in the embodiment of the disclosure, two or more sound reception combinations having different sound receiving directions are combined. A weighting operation (i.e., multiplying the first sound signal of each sound reception combination by a corresponding weight and adding the results) is performed on the sound signals of the sound reception combinations using corresponding weights. Accordingly, a new sound receiving direction is obtained. This new sound receiving direction may be different from the sound receiving directions of the combined sound reception combinations.

Figure 4A:
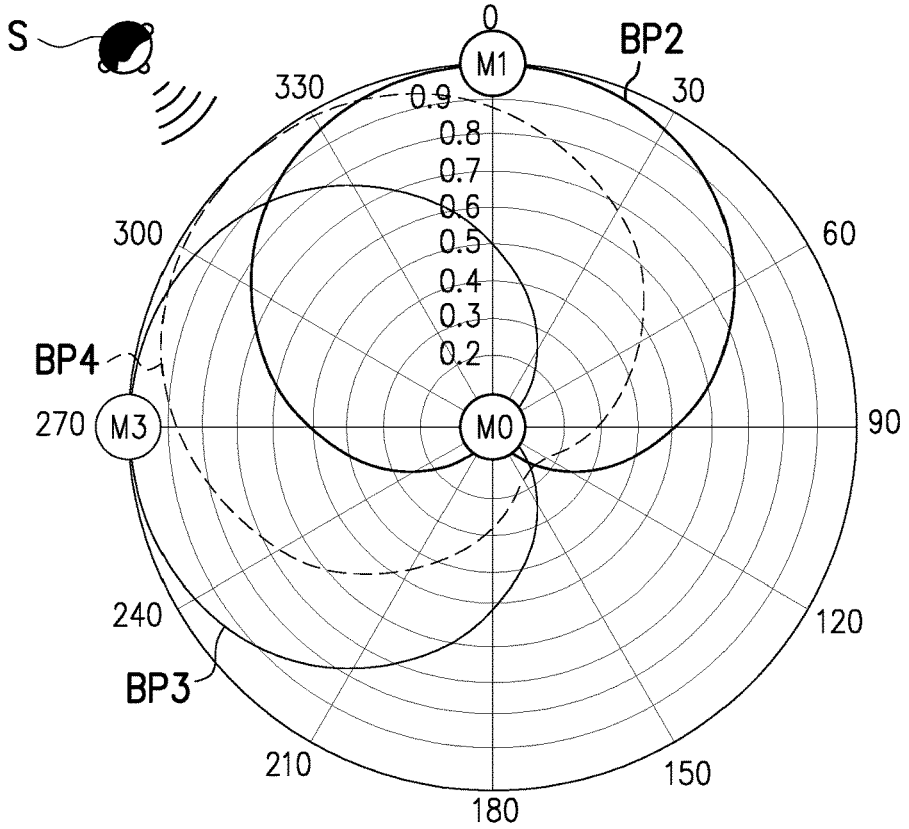
FIGS. 4A to 4C illustrate optimal sound receiving directions formed by different weights.
Figure 4B:
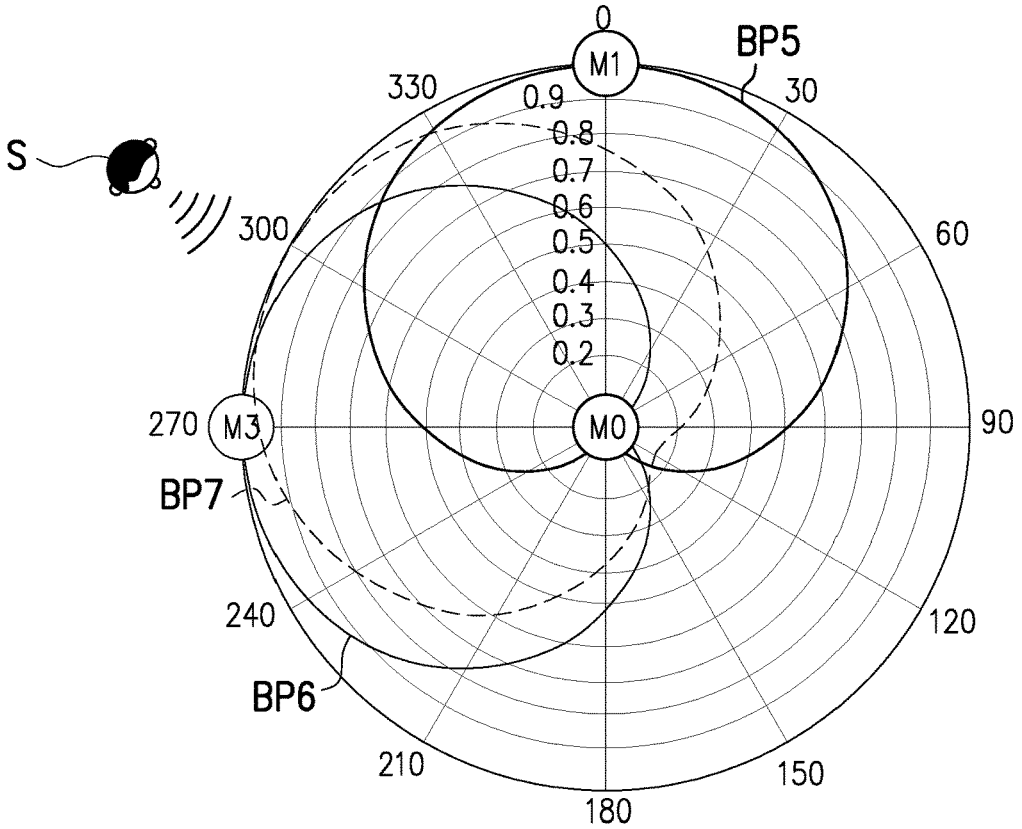
Figure 4C:
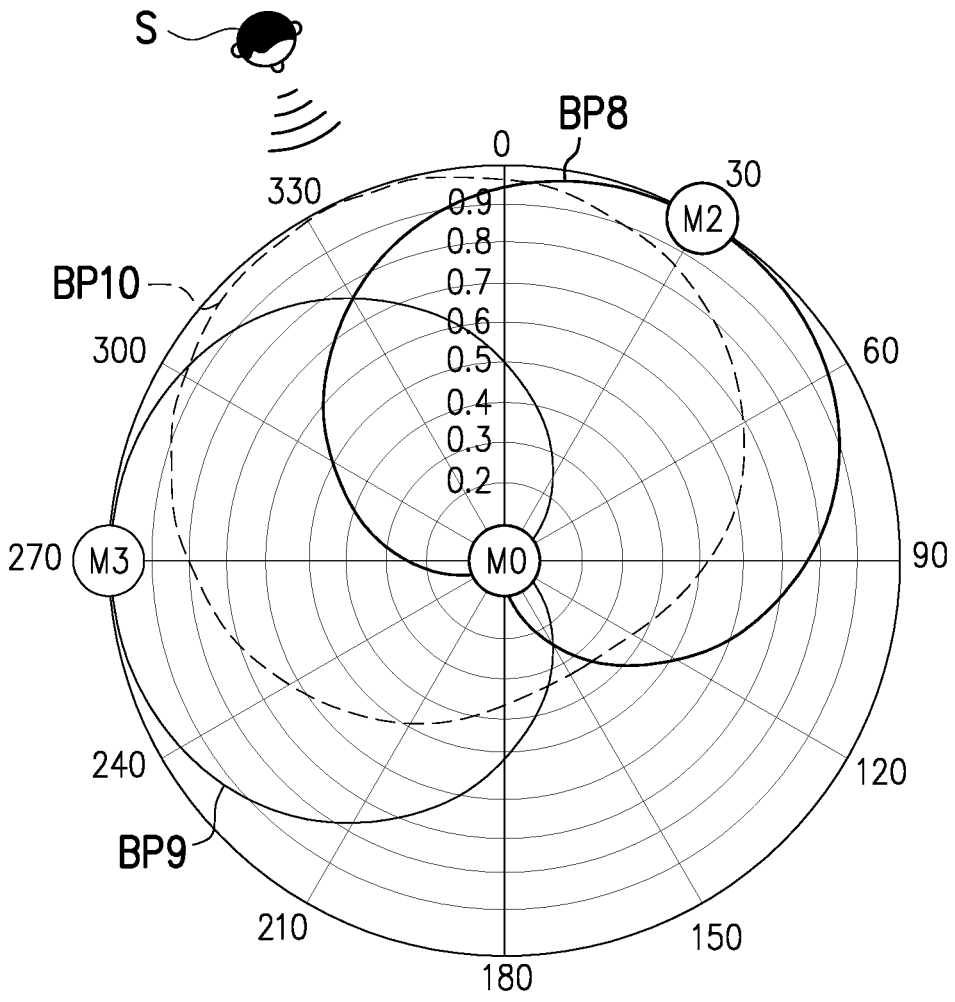

For example, FIGS. 4A to 4C illustrate optimal sound receiving directions formed by different weights. Referring first to FIG. 4A, it is assumed that the sound reception apparatuses M0 and M1 form a sound reception combination, and if the sound reception apparatus M0 is taken as the reference position, the sound receiving direction corresponding to a beam pattern BP2 of the sound reception combination is 0 degree. The sound reception apparatuses M0 and M3 form another sound reception combination, and if the sound reception apparatus M0 is taken as the reference position, the sound receiving direction corresponding to a beam pattern BP3 of the sound reception combination is 270 degrees. If the weight determination module 133 assigns a weight proportion of 1:1 to the beam patterns BP2 and BP3, and a weighting operation is performed on the first sound signals of the two sound reception combinations, a beam pattern BP4 is formed, and the sound receiving direction corresponding to the beam pattern BP4 is 315 degrees.

Referring to FIG. 4B, it is assumed that a sound reception combination of the sound reception apparatuses M0 and M1 forms a beam pattern BP5, and the sound receiving direction corresponding to the beam pattern BP5 is 0 degree. It is assumed that a sound reception combination of the sound reception apparatuses M0 and M3 forms a beam pattern BP6, and the sound receiving direction corresponding to the beam pattern BP6 is 270 degrees. If the weight determination module 133 assigns a weight proportion of 1:2 to the beam patterns BP5 and BP6, a beam pattern BP7 is formed, and the sound receiving direction corresponding to the beam pattern BP7 is 287 degrees. Compared with FIG. 4A, as a weight changes, different sound receiving directions are formed.

Referring to FIG. 4C, it is assumed that a sound reception combination of the sound reception apparatuses M0 and M2 forms a beam pattern BP8, and the sound receiving direction corresponding to the beam pattern BP8 is 30 degrees. It is assumed that a sound reception combination of the sound reception apparatuses M0 and M3 forms a beam pattern BP9, and the sound receiving direction corresponding to the beam pattern BP9 is 270 degrees. If the weight determination module 133 assigns a weight proportion of 1:1 to each of the beam patterns BP8 and BP9, a beam pattern BP10 is formed, and the sound receiving direction corresponding to the beam pattern BP10 is 330 degrees. Compared with FIG. 4A, as a sound receiving direction of a certain sound reception combination changes, different sound receiving directions are also formed.

It is to be noted that, the positions and the sound reception combinations of the sound reception apparatuses M0 to M3 in FIGS. 4A to 4C are only illustrated as an example, and the disclosure is not limited thereto. For example, the sound reception apparatus M0 may be away from the reference position, the sound reception apparatus M1 may be closer to the sound reception apparatus M0, and the sound reception apparatuses M1 and M3 may form a sound reception combination. Alternatively, the sound reception apparatuses M0 to M3 may be simultaneously arranged to form three sound reception combinations (e.g., the sound reception apparatuses M0 and M1, the sound reception apparatuses M0 and M2, and the sound reception apparatuses M0 and M3). The number of sound reception apparatuses may be increased or decreased as needed, and the number of sound reception combinations may be changed accordingly.

Based on the aforementioned inventive spirit, the weight determination module 133 determines the reference position and provides several reference source directions radiated from the reference position. Each reference source direction has a predetermined weight corresponding to the sound reception combinations (e.g., the sound reception apparatus M0 shown in FIG. 4A is located at the reference position) (the predetermined weight may include specific proportion or several predetermined weight). In an embodiment, the weight determination module 133 may assign a specific predetermined weight to each sound reception combination, and then perform a weighting operation on two or more sound reception combinations with the corresponding predetermined weights, thereby obtaining a specific reference source direction. Next, the predetermined weight of each sound reception combination is gradually changed (e.g., increased/decreased by a specific value), or the combination of different sound reception combinations is changed, thereby establishing a lookup table of reference source direction and predetermined weight. In another embodiment, the weight determination module 133 may first determine several reference source directions, and calculate the predetermined weights corresponding to different sound reception combinations respectively, thereby establishing a lookup table of reference source direction and predetermined weight.

Next, the weight determination module 133 determines the sound source direction of the sound source position detected by the source detection module 131 relative to the aforementioned reference position. For example, the sound source direction of the sound source S in FIG. 4A is 315 degrees, and the sound source direction of the sound source S in FIG. 4B is 287 degrees. The weight determination module 133 determines the weight corresponding to the sound receiving combinations according to the corresponding predetermined weight of the reference source direction near the sound source direction. For example, according to the lookup table of reference source direction and predetermined weight, the weight determination module 133 uses the predetermined weight of the reference source direction closest to the sound source direction as the weight corresponding to the sound reception combinations. Alternatively, the weight determination module 133 gradually adjusts the predetermined weight of the reference source direction close to the sound source direction, such that the new reference source direction is closer to or equal to the sound source direction.

It is to be noted that, in the foregoing embodiment, the weight is determined using the lookup table of reference source direction and predetermined weight. However, in other embodiments, the weight determination module 133 may directly calculate the weight corresponding to each sound reception combination according to the sound source direction.

On the other hand, in some application scenarios, the sound source position may be less suitable for sound reception of some sound reception combinations. Taking FIG. 4A as an example, it is assumed that the sound source position of the sound source S is moved to a position at which an angle of 90 degrees can be formed, and the beam pattern of the sound reception combination of the sound reception apparatuses M0 and M3 is less sensitive to the 90-degree direction. Accordingly, the output determination module 135 of the embodiment of the disclosure selects the sound reception combinations having a beam pattern covering this sound source direction. That is, the weight determination module 133 only needs to determine the weights of the sound reception combinations selected by the output determination module 135.

Next, the weight determination module 133 performs a weighting operation (i.e., multiplying the first sound signal of each sound reception combination by a corresponding weight and adding the results) on the first sound signals (which have been processed based on the beamforming algorithm) of the sound reception combinations using the determined corresponding weights to generate a second sound signal. Accordingly, the sound output module 137 can outputs the second sound signal from the first sound signals based on the relationship (e.g., specific proportion or weight of each sound reception combination, etc.) among the sound reception combinations (step S270). The processed second sound signal may further be stored in the storage 130 or provided to other external apparatuses (e.g., speakers, amplifiers, speech recognition engines, or cloud servers, etc.).

To further facilitate understanding of the spirit of the disclosure, another embodiment will be described below. It is to be noted that the positions, sound reception combinations and the number of unit in this embodiment are only used to illustrate an example, and may be adjusted according to needs.

Figure 5A:
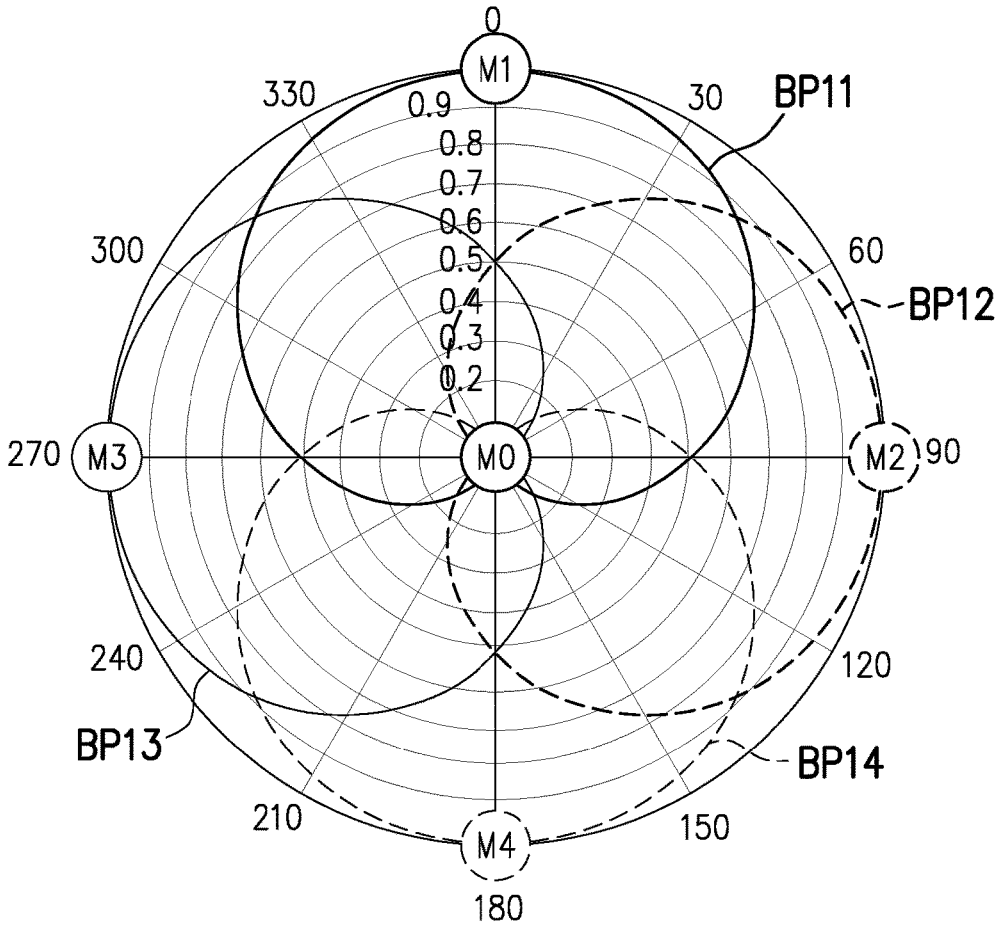
FIG. 5A illustrates an arrangement position of a sound reception apparatus and a beam pattern thereof according to an embodiment of the disclosure.
Figure 5B:
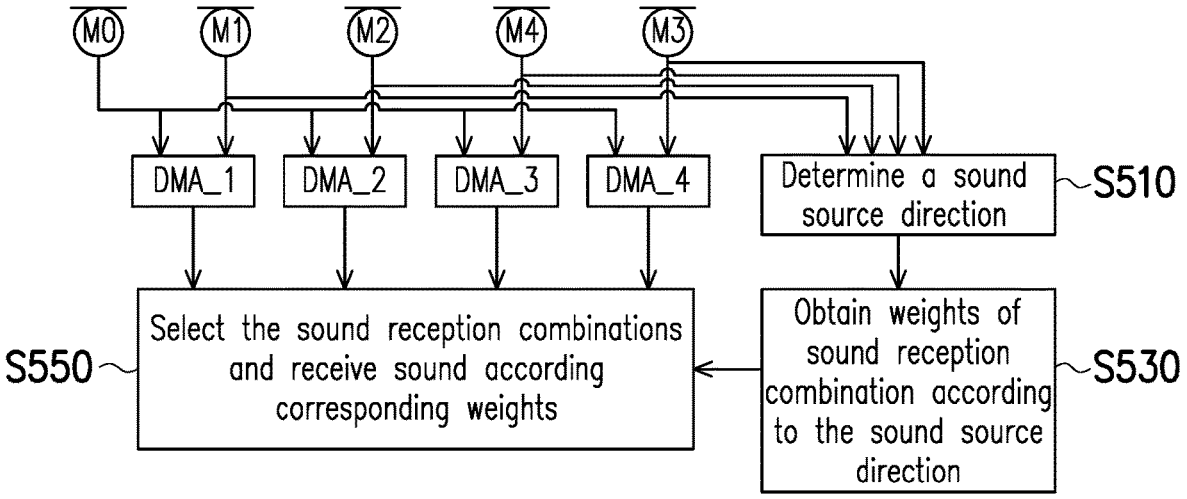
FIG. 5B is a flowchart of a sound processing method according to an embodiment of the disclosure.
Figure 5C:
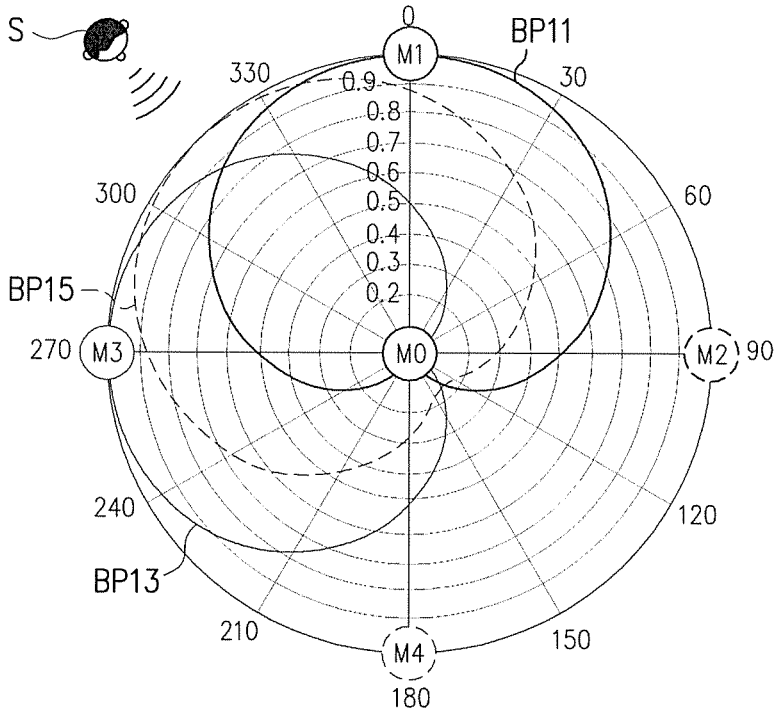
FIG. 5C illustrates an example in which a sound receiving direction corresponds to a sound source direction.

FIG. 5A illustrates arrangement positions of the sound reception apparatuses M0 to M4 and beam patterns BP11 to BP14 thereof according to an embodiment of the disclosure. Referring to FIG. 5A, it is assumed that the sound reception apparatuses M0 and M1 form a first sound reception combination, the sound reception apparatuses M0 and M2 form a second sound reception combination, the sound reception apparatuses M0 and M3 form a third sound reception combination, and the sound reception apparatuses M0 and M4 form a fourth sound reception combination. Please also refer to FIG. 5B. FIG. 5B is a flowchart of a sound processing method according to an embodiment of the disclosure. The processor 150 obtains first sound signals through the sound reception apparatuses M0 to M4 simultaneously. The weight determination module 133 processes the first sound signal of each sound reception combination using a DMA algorithm, to obtain signals DMA_1 to DMA_4 of the respective sound reception combinations that have been processed by the algorithm. Accordingly, the sound reception combinations form beam patterns BP11 to BP14 (the sound receiving directions thereof are 0 degree, 90 degrees, 180 degrees, and 270 degrees, respectively) as shown in FIG. 5A. Referring next to FIGS. 5B and 5C, the source detection module 131 determines the sound source position based on the SSL technique, so as to obtain the sound source direction of the sound source relative to the reference position where the sound reception apparatus M0 is located (step S510). As shown in FIG. 5C, the sound source direction of the sound source S is assumed to be 315 degrees.

According to coverage angles of the beam patterns BP11 to BP14, the output determination module 135 determines which of the sound reception combinations covers the sound source direction (as shown in FIG. 5C, since the sound source direction is between 270 degrees and 0 degree, the output determination module 135 selects the beam patterns BP11 and BP13). The weight determination module 133 looks up the sound source direction in a weight lookup table (1), thereby obtaining a weight proportion (1:1) corresponding to the beam pattern BP and BP13 (i.e., two sound reception combinations) (step S530).

TABLE 1

| | Angle | | | | | | | | | |
|---|---|---|---|---|---|---|---|---|---|---|
| | 270 degrees | | 292 degrees | | 315 degrees | | 329 degrees | | 0 degree | |
| | Sound reception combination | | | | | | | | | |
| | M0, M4 | M0, M1 | M0, M4 | M0, M1 | M0, M4 | M0, M1 | M0, M4 | M0, M1 | M0, M4 | M0, M1 |
| Weight | 1 | 0 | 1 | 0.4 | 1 | 1 | 0.6 | 1 | 0 | 1 |

The weight determination module 133 selects the sound reception combinations (i.e., the sound reception combination of the sound reception apparatuses M0 and M1, and the sound reception combination of the sound reception apparatuses M0 and M3) corresponding to the signals DMA_1 and DMA_4, and multiplies the signals DMA_1 and DMA_4 of the two sound reception combinations respectively by a weight of 1 and then adds the results together. Accordingly, a beam pattern BP15 with a sound receiving direction of 315 degrees is obtained. The sound output module 137 continues to receive sound according to the corresponding weights until the sound source position is changed (step S550).

Figure 5D:
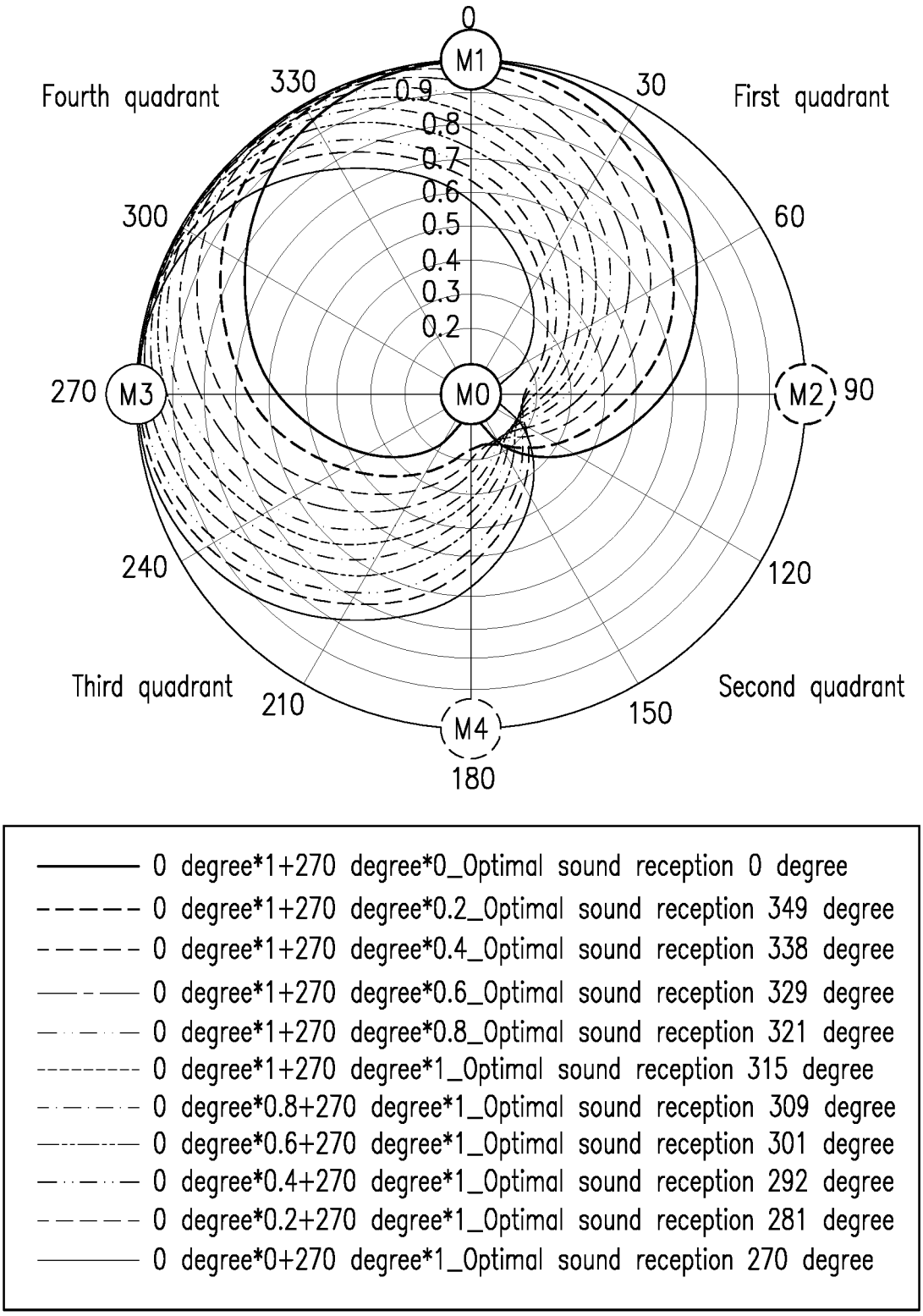
FIG. 5D illustrates optimal sound receiving directions formed by different weights.

FIG. 5D illustrates optimal sound receiving directions formed by different weights. Taking two sound reception combinations (i.e., the sound reception combination of the sound reception apparatuses M0 and M1 and the sound reception combination of the sound reception apparatuses M0 and M3) as an example, by changing the corresponding weights and then performing the weighting operation on the first sound signals, different beam patterns as shown in FIG. 5D can be obtained, and different sound receiving directions are thus formed. The same also applies to the other sound reception combinations. Thus, the sound processing apparatus 1 can configure the sound receiving directions of the sound reception combinations to form any sound source direction.

In summary, in the sound processing apparatus and the sound processing method thereof according to the embodiment of the disclosure, the sound receiving directions of two or more sound reception combinations can be automatically adjusted based on the sound source position. The weights corresponding to each the sound receiving direction can be changed, so that a new sound receiving direction corresponding to the sound source direction can be obtained by subjecting the first sound signals of the sound receiving combinations to the weighting operation. In this way, there is no need for the user to manually adjust the position of the sound reception apparatus or to manually switch the sound reception apparatus in order to conform to the actual application situation.

Although the disclosure has been described with reference to the above examples, it will be apparent to one of ordinary skill in the art that modifications to the described examples may be made without departing from the spirit of the disclosure. Accordingly, the scope of the disclosure will be defined by the attached claims and not by the above detailed descriptions.

What is claimed is:

1. A sound processing method, comprising:

obtaining a plurality of first sound signals corresponding to a plurality of sound reception sources;

forming a plurality of sound reception groups from the plurality of first sound signals, wherein each of the plurality of sound reception groups corresponds to one of the plurality of sound receiving directions;

determining a sound source position of a sound source relative to the plurality of sound reception sources;

determining weights of a plurality of sound receiving directions corresponding to the plurality of sound reception sources according to the sound source position, wherein the plurality of sound receiving directions relate to directionality of the plurality of sound reception sources; and outputting a second sound signal from the plurality of first sound signals based on the weights of the plurality of sound receiving directions, comprising:

performing a weighting operation on the plurality of sound reception groups with the weights of the plurality of sound receiving directions to generate the second sound signal.

2. The sound processing method according to claim 1, wherein each of the plurality of sound reception groups comprises at least one of the plurality of sound reception sources, and the step of determining the weights of the plurality of sound receiving directions corresponding to the plurality of sound reception sources according to the sound source position comprises:

determining corresponding weights according to the plurality of sound receiving directions of the plurality of sound reception groups.

3. The sound processing method according to claim 1, wherein the step of forming the plurality of sound reception groups from the plurality of first sound signals comprises:

determining the sound receiving direction corresponding to one of the plurality of sound reception groups according to a beamforming algorithm.

4. The sound processing method according to claim 3, wherein the beamforming algorithm is a differential microphone array (DMA) algorithm, and the step of determining the sound receiving direction corresponding to one of the plurality of sound reception groups according to the beamforming algorithm comprises:

processing the plurality of first sound signals in the corresponding sound reception groups using the DMA algorithm.

5. The sound processing method according to claim 2, further comprising, before determining the corresponding weights according to the plurality of sound receiving directions of the plurality of sound reception groups:

determining a reference position; and providing a plurality of reference source directions radiated from the reference position, wherein each of the plurality of reference source directions has a predetermined weight corresponding to the plurality of sound reception groups.

6. The sound processing method according to claim 5, wherein the step of determining the corresponding weights according to the plurality of sound receiving directions of the plurality of sound reception groups comprises:

determining a plurality of sound source direction of the sound source position relative to the reference position; and determining the weights corresponding to the plurality of sound reception groups according to the predetermined weight corresponding to each of the plurality of reference source directions near the sound source direction.

7. The sound processing method according to claim 5, wherein the step of determining the corresponding weights according to the plurality of sound receiving directions of the plurality of sound reception groups comprises:

determining a sound source direction of the sound source position relative to the reference position; and selecting the plurality of sound reception groups having a beam pattern covering the sound source direction.

8. The sound processing method according to claim 1, wherein the step of determining the sound source position of the sound source relative to the plurality of sound reception sources comprises:

determining the sound source position based on a sound source localization (SSL) technique.

9. A sound processing apparatus, adapted for processing a plurality of first sound signals, and the sound processing apparatus comprising:

a storage, storing a plurality of modules and the plurality of first sound signals, wherein the modules comprise a source detection module, a weight determination module and a sound output module, and the plurality of first sound signals correspond to a plurality of sound reception sources; and a processor, coupled to the storage and executing the modules stored in the storage, wherein the source detection module determines a sound source position of a sound source relative to the plurality of sound reception sources;

the weight determination module fo ns a plurality of sound reception groups from the plurality of first sound signals, wherein each of the plurality of sound reception groups corresponds to one of the plurality of sound receiving directions;

the weight determination module determines weights of a plurality of sound receiving directions corresponding to the plurality of sound reception sources according to the sound source position, wherein the plurality of sound receiving directions relate to directionality of the plurality of sound reception sources; and the sound output module outputs a second sound signal from the plurality of first sound signals based on the weights of the plurality of sound receiving directions, wherein the weight determination module performs a weighting operation on the plurality of sound reception groups with the weights of the plurality of sound receiving directions to generate the second sound signal.

10. The sound processing apparatus according to claim 9, wherein each of the plurality of sound reception groups comprises at least one of the plurality of sound reception sources, and the weight determination module determines the corresponding weights according to the plurality of sound receiving directions of the plurality of sound reception groups.

11. The sound processing apparatus according to claim 9, wherein the weight determination module determines the sound receiving direction corresponding to one of the plurality of sound reception groups according to a beamforming algorithm.

12. The sound processing apparatus according to claim 11, wherein the weight determination module processes the plurality of first sound signals in the corresponding sound reception group using a differential microphone array (DMA) algorithm.

13. The sound processing apparatus according to claim 10, wherein the weight determination module determines a reference position and provides a plurality of reference source directions radiated from the reference position, wherein each of the plurality of reference source directions has a predetermined weight corresponding to the plurality of sound reception groups.

14. The sound processing apparatus according to claim 13, wherein the weight determination module determines a sound source direction of the sound source position relative to the reference position, and determines the weights corresponding to the plurality of sound reception groups according to the predetermined weight corresponding to each of the plurality of reference source directions near the sound source direction.

15. The sound processing apparatus according to claim 13 wherein the modules further comprise:

an output determination module, wherein the weight determination module determines a sound source direction of the sound source relative to the reference position, and the output determination module selects the plurality of sound reception groups having a beam pattern covering the sound source direction.

16. The sound processing apparatus according to claim 9, wherein the source detection module determines the sound source position based on a sound source localization (SSL) technique.

17. The sound processing apparatus according to claim 9, wherein the processor is further connected to a plurality of sound reception apparatuses, and each of the plurality of sound reception apparatuses corresponds to one of the plurality of sound reception sources and obtains one of the plurality of the first sound signals.

* * * * *